United States Patent [19]

Levenson

[11] 4,070,789

[45] Jan. 31, 1978

[54] FOLDING DOLL HOUSE

[76] Inventor: Ellene S. Levenson, 23930 Killion St., Woodland Hills, Calif. 91364

[21] Appl. No.: 718,958

[22] Filed: Aug. 30, 1976

[51] Int. Cl.[2] ..... A63H 33/00

[52] U.S. Cl. ..... 46/12; 229/41 R; 229/DIG. 3

[58] Field of Search ..... 46/12, 21, 11, 1 L, 46/13; 229/DIG. 3, 41 R

[56] References Cited

U.S. PATENT DOCUMENTS

| | | | |
|---|---|---|---|
| 524,078 | 8/1894 | Walker | 46/21 X |
| 1,270,642 | 6/1918 | Martin | 229/DIG. 3 |
| 2,872,753 | 2/1959 | Fenton | 46/12 |
| 3,363,360 | 1/1968 | Ryan | 46/12 |

FOREIGN PATENT DOCUMENTS

| | | | |
|---|---|---|---|
| 32,246 | 12/1961 | Finland | 229/DIG. 3 |
| 77,914 | 1/1949 | Norway | 46/12 |

*Primary Examiner*—F. Barry Shay
*Attorney, Agent, or Firm*—Spensley, Horn & Lubitz

[57] ABSTRACT

A folding doll house which comprises an upper structure and a lower structure adapted to fold into and become a part of said upper structure. The upper structure has at least a top portion, a back portion and a side portion and the lower structure has a pair of lower side walls coupled to the upper structure at the lower side edges thereof and adapted to fold inwardly and upwardly toward the bottom of the upper structure and a lower back and floor portion coupled to the upper structure at the bottom rear edge thereof and adapted to fold inwardly to form the bottom and front of the upper structure. The upper structure may further include a bottom portion under which the lower side walls and a part of the lower back portion and floor portion may be folded and a front portion coupled to the top portion to form an outer front portion for the doll house.

7 Claims, 7 Drawing Figures

FOLDING DOLL HOUSE

BACKGROUND OF THE INVENTION

1. Field of the Invention

The present invention relates to a new and useful doll house and in particular to a multi-level doll house which may be conveniently folded into a single level carry case.

2. Description of the Prior Art

There are many types of doll houses in the prior art which may be converted into carry cases. One of these doll houses is illustrated in U.S. Pat. No. 2,872,753 issued Feb. 10, 1959 to R. S. Fenton for a collapsable doll house construction in which a carry case is unfolded to form a single level doll house having a floor and three walls and a plurality of furniture built therein.

A second example of a prior art doll house may be found in U.S. Pat. No. 3,363,360 issued Jan. 16, 1968. In this structure, a carry case is unfolded to yield a single level structure having a plurality of moveable walls which can be placed in different positions to make different types of houses. In addition, the walls contain certain elaborate features such as three dimensional built-in simulated cooking ranges, cupboards, wardrobes and the like.

Both of the above structures, however, are comparatively expensive to manufacture because of their complicated construction and provide only a limited play value due to their single level nature.

Accordingly it is a primary object of the present invention to provide a multi-level doll house which may be folded into a single level carry case type structure.

It is another object of the present invention to provide a multi-level doll house which, when collapsed, forms a compact structure resembling a carry case, but which expands to form a multi-level, multi-room house.

It is a further object of the present invention to provide a multi-level doll house which is inexpensive to manufacture and easily folds into a structure resembling a carry case.

SUMMARY OF THE INVENTION

A multi-level doll house which can be folded into a single level structure which may resemble a carry case is provided. The doll house comprises an upper structure and a lower structure which is foldable into the upper structure. The upper structure has at least top, back, and side portions or panels and may also have a bottom and a front portion or panel. The lower structure has a plurality of lower side walls coupled to the upper structure at the lower side edges thereof and adapted to fold under the bottom of the upper structure and a lower back and floor portion or panel coupled to the upper structure at the bottom rear edge thereof and adapted to fold under the lower side walls and to form a front portion for the upper structure. The lower back and floor portion or panel comprises a plurality of foldable panels in which certain ones of the panels are folded to form the bottom of the folding doll house structure and other ones of the panels are folded to become either the front wall of the folding doll house structure or an inner front wall of the folding doll house when the upper structure has a front portion coupled to the top portion of the structure which forms an outer front wall of the folding doll house structure. A plurality of partitions are provided which are insertable into the lower portion of the multilevel doll house to form a plurality of rooms and one or more additional floors. A handle is provided coupled to the top portion so that the entire structure may be easily carried.

The novel features which are believed to the characteristic of the invention together with further objects and advantages thereof will be better understood from the following description considered in connection with the accompanying drawings. It is to be expressly understood, however, that the drawings are for purposes of illustration and description only and are not intended as a definition of the limits of the invention.

DESCRIPTION OF THE INVENTION

Figure 1:
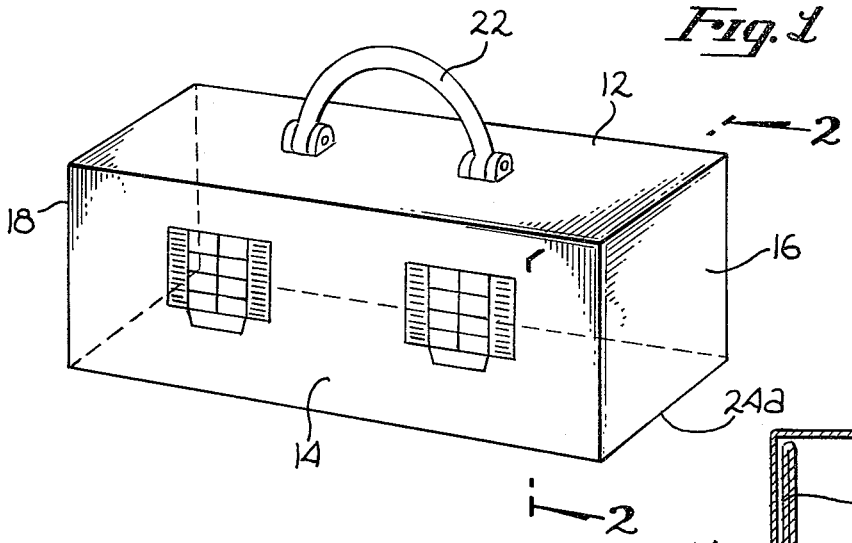
FIG. 1 is a perspective view of a doll house, constructed in accordance with the present invention, in its collapsed or portable condition.
Figure 2:
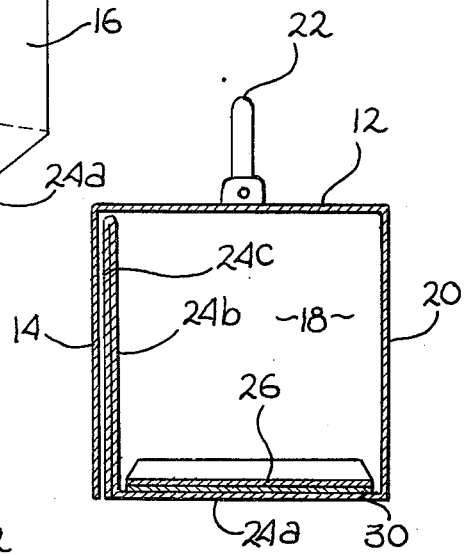
FIG. 2 is a cross sectional view of the doll house of FIG. 1 along the line 2—2.

In FIG. 1 a perspective view of a preferred embodiment of the present invention is illustrated. The multi-level folding doll house is shown in its collapsed state as a carry case 10 having a top portion 12, a front portion 14, side portions 16 and 18, a back portion 20 and a handle 22. As is shown with respect to FIGS. 2 and 3, the front portion 14 lifts up to reveal a folded back and floor portion 24 *a,b,c* which forms the bottom floor of the carry case structure 10 and folds inside the front wall 14. Also shown in cross section in FIG. 2 is the portion 26 of the upper structure of the doll house and which forms the bottom portion of such upper structure when the doll house is in its opened condition, and the folded side wall 30 in its uplifted, collapsed condition. The side wall 32 is not illustrated in FIG. 2.

Figure 3:
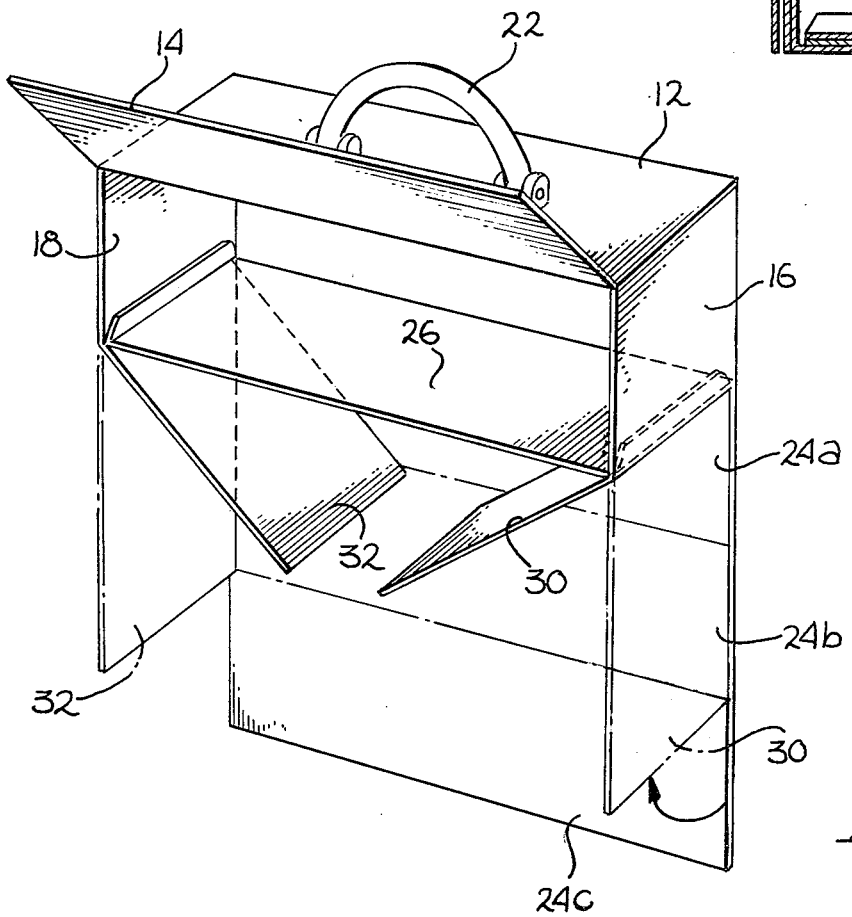
FIG. 3 illustrates the doll house of FIG. 1 in a partially opened condition.

In FIG. 3 the doll house of the present invention is shown in a partially opened state. Front portion 14 has been lifted allowing the lower back and floor portion 26 *a,b,c* to drop down and the side walls 30 and 32 to also drop down from beneath the bottom portion 26. As is shown in FIG. 3, the lower back and floor portion 24 *a,b,c* comprises a first back portion 24*a*, a second back portion 24*b* and a floor portion 24*c*. The back portions 24*a* and 24*b* comprise the back portion of the lower structure of the doll house and the floor portion 24*c* comprises the floor of the lower structure of the doll house.

Figure 4:
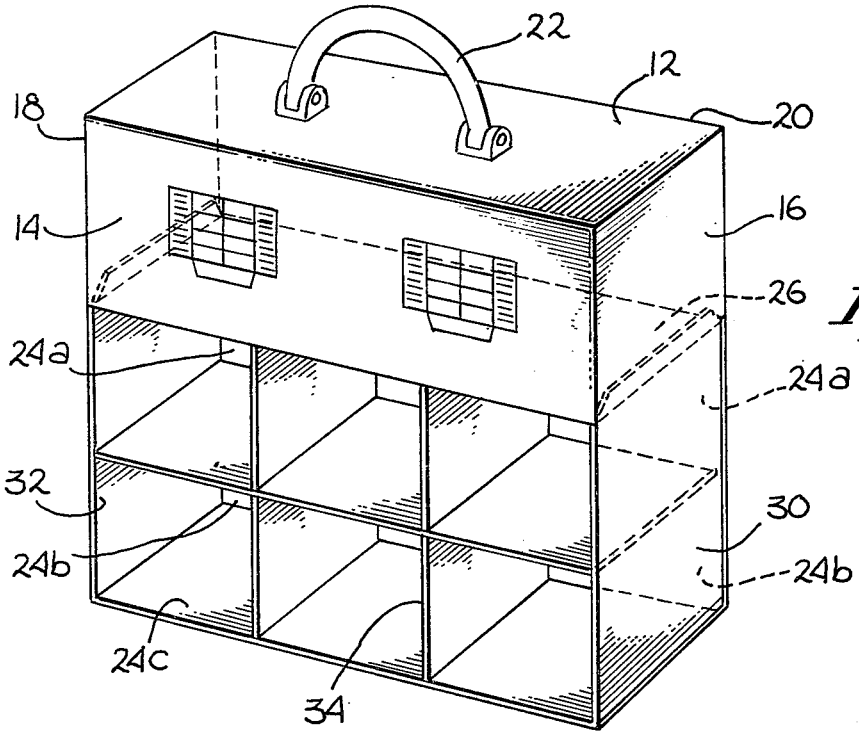
FIG. 4 is an illustration of the doll house of FIG. 1 in a fully opened condition with partitions inserted therein.

In FIG. 4 the doll house is illustrated in its completely opened state. The front portion 14 has been dropped down to form an enclosed dormer room and the side portions 30 and 32 have been fully extended to form the sides of the doll house. A partition 34 has been inserted to form a plurality of rooms and to provide a plurality of floors in the lower structure portion of the doll house, with back portion 24*a* forming the back of the second floor of the doll house and back portion 24*b* forming the back of the first floor of the doll house.

Figure 5:
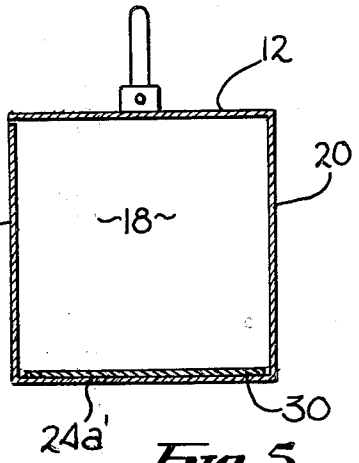
FIG. 5 is a cross sectional view of the simplified embodiment of the doll house shown in FIG. 1.

In FIG. 5 a cross sectional view of a simplified doll house structure is illustrated. In this embodiment the lower floor portion 24*c*′ alone forms the front portion of the carry case 10 while the lower back portion 24*a*′ forms the bottom of the carry case 10. When the carry case 10 is opened to form the expanded doll house, portion 24*c*′ drops down to form the floor of the first story of the doll house and portion 24*a*′ forms the back of the first story of the doll house. Side portions 30 and 32 drop down to form the walls of the lower portion of the doll house. A partition such as provided in FIG. 4 can then be inserted to form the floor of the upper portion of the doll house and to divide the doll house into various rooms.

Figure 6:
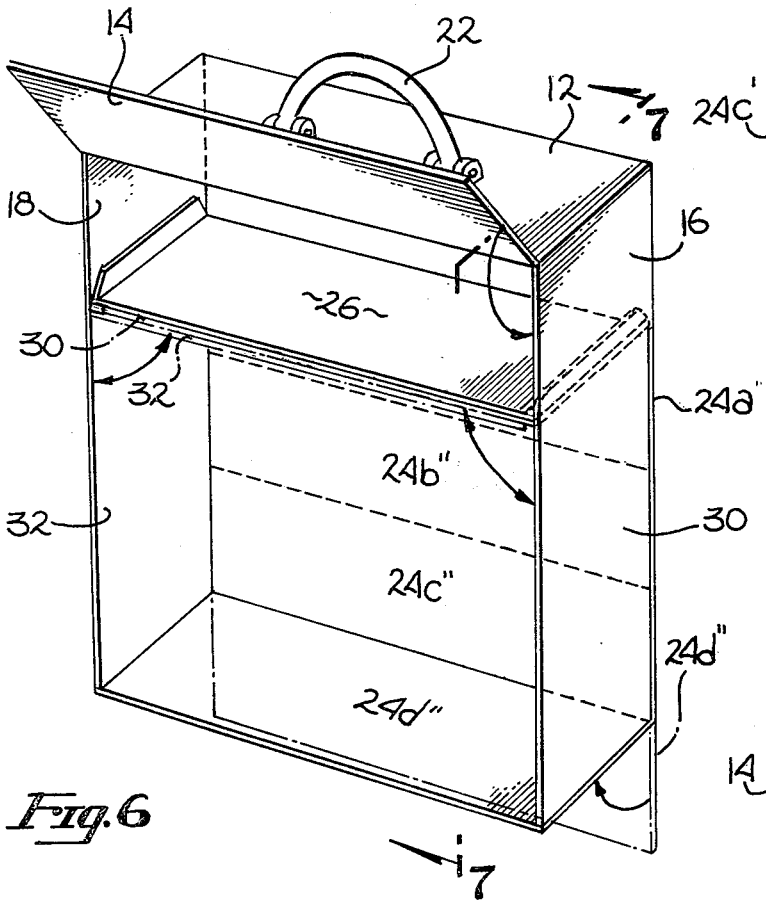
FIG. 6 is an illustration of a more elaborate embodiment of the doll house illustrated in FIG. 1.
Figure 7:
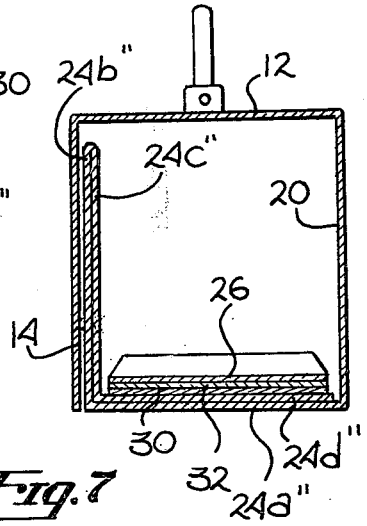
FIG. 7 is a cross-sectional view of the doll house of FIG. 6 along the line 7—7.

In FIGS. 6 and 7 a more elaborate embodiment of the doll house is illustrated. The lower back and floor portion is comprised of portions 24*a*″, 24*b*″, 24*c*″ and 24*d*″, while side walls 30 and 32 now extend the full length of the bottom portion 26 and thus overlap one another in the collapsed state, with both sidewalls 30 and 32 lying adjacent to the bottom portion or panel 26, as shown in phantom in FIG. 6 and in cross section in FIG. 7. When the front portion 14 is lifted, the lower back and floor portion drops down with portions 24*a*″, 24*b*″ and 24*c*″ forming the back walls of the first, second and third floors of the lower structure and portion 24*d*″ forming the floor of the lower portion of the structure. In this embodiment of the invention, the floor portion 24*d*″ folds in the collapsed state underneath the folding side walls 30 and 32 and the floor portion 26 of the upper structure. Partitions such as shown in FIG. 4 may then be inserted to form the floors of the second and third stories of the doll house and the rooms of the doll house.

A folding doll house has thus been provided which is inexpensive to manufacture and easy to assemble and which can be folded from a multi-level structure into a single level carry case. Having thus described the invention, it is apparent that numerous modifications and variations may be made by those skilled in the art. Thus the invention is to be limited only by the spirit and scope of the appended claims.

What is claimed is:

1. A folding doll house comprising:

an upper structure having top, bottom, back, front and side panels coupled to form a box-like structure, said front panel being coupled only to said top panel;

a plurality of lower side walls;

means coupling said lower side walls to said upper structure at the lower side edges thereof, whereby said lower side walls are adapted to fold to lie adjacent to said bottom panel outside of said upper structure;

a foldable lower back and floor panel; and means coupling said lower back and floor panel to said upper structure at the bottom rear edge thereof, whereby said lower back and floor panel is adapted to fold to lie adjacent to said lower side walls outside of said upper structure and adjacent said front panel within said upper structure, whereby the lower side walls and the lower back and floor panel of said dollhouse may be folded adjacent to said upper structure.

2. The doll house of claim 1 wherein said top panel has a handle coupled thereto, said upper structure comprising a carry case.

3. The doll house of claim 1 wherein said lower side walls are coupled to said side panels of said upper structure.

4. The doll house of claim 1 wherein said lower back and floor panel is coupled to the back panel of said upper structure.

5. The doll house of claim 1 wherein said lower back and floor panel comprises a first and second plurality of foldable panels, said first plurality of said panels being adapted to fold to lie adjacent said lower side walls outside of said upper structure and said second plurality of said panels being adapted to lie adjacent said front panel within said upper structure.

6. The doll house of claim 1 wherein the floor portion of said lower back and floor panel folds under said front panel and at least a part of the lower back portion of said lower back and floor panel folds under said lower side walls.

7. The doll house of claim 1 further comprising a plurality of partitions insertable within said lower side walls and lower back and floor panel of said doll house to form a plurality of rooms and one or more additional floors.

* * * * *